United States Patent [19]

Löfgren

[11] Patent Number: 4,714,018

[45] Date of Patent: Dec. 22, 1987

[54] METHOD AND MEANS FOR CONNECTING FUSES

[75] Inventor: Lars-Gunnar Löfgren, Nora, Sweden

[73] Assignee: Nitro Nobel AB, Gyttorp, Sweden

[21] Appl. No.: 880,020

[22] Filed: Jun. 30, 1986

[30] Foreign Application Priority Data

Jul. 1, 1985 [SE] Sweden ..... 8503278

[51] Int. Cl.[4] ..... C06C 5/04; F41D 1/04

[52] U.S. Cl. ..... 102/275.7; 102/275.12

[58] Field of Search ..... 102/275.4, 275.5, 275.7, 102/275.8, 275.1, 275.2, 275.3, 275.12

[56] References Cited

U.S. PATENT DOCUMENTS

| | | | |
|---|---|---|---|
| Re. 30,621 | 5/1981 | Calder et al. | 102/275.7 X |
| 2,952,206 | 9/1960 | Becksted | 102/275.7 |
| 3,175,491 | 3/1965 | Robertson | 102/275.7 |
| 3,590,739 | 7/1971 | Persson | 102/275.5 |
| 3,713,384 | 1/1973 | Turnbull | 102/275.5 |
| 3,878,785 | 4/1975 | Lundborg | 102/275.4 |
| 4,248,152 | 2/1981 | Yunan | 102/275.4 |
| 4,424,747 | 1/1984 | Yunan | 102/275.2 |
| 4,426,933 | 1/1984 | Yunan | 102/275.4 X |
| 4,481,884 | 11/1984 | Yunan | 102/275.4 X |
| 4,495,867 | 1/1985 | Mitchell et al. | 102/275.7 X |

FOREIGN PATENT DOCUMENTS

| | | |
|---|---|---|
| 2255106 | 6/1973 | Fed. Rep. of Germany . |
| 420597 | 10/1981 | Sweden . |

*Primary Examiner*—David H. Brown

*Attorney, Agent, or Firm*—Burns, Doane, Swecker & Mathis

[57] ABSTRACT

Method and means for securing signal transmission from a detonating cord to one or several shock wave initiable low energy fuses whereby a fold or loop (3) is formed on the detonating cord (1) so that the two halves of the fold extend away from the main direction of the cord and whereby the fuse or fuses (2) are aligned within signal receiving distance from both cord fold halves before initiation of the cord.

19 Claims, 15 Drawing Figures

METHOD AND MEANS FOR CONNECTING FUSES

BACKGROUND

This invention relates to the art of blasting and, more particularly, to a method and means for securing signal transmission from a detonating cord and to one or several shock wave initiable low energy fuses.

For the purpose of transmitting initiation signals to explosive charges, various types of fuses are used as alternatives to electrical means. For reproducible timing between different charges it is necessary to use fuses of high signal speed in which a shock wave is rate determinant for transmission. High speed fuses are of two general types. Detonating cords with a relatively high loading of core explosives are structurally destroyed when used but are able to initiate nearby explosives. Low energy fuses have a lower core loading resulting in a weak shock unable to initiate nearby explosives and often leaving the external fuse layers structurally unchanged after use.

It is often desirable to combine the two types of fuses in the same blasting network. For example, low energy fuses are preferred for the branches leading down the boreholes since they allow bottom initiation with a blasting cap without initiation, compression or other negative effects on the charge from the descending impulse. Detonating cords have some practical and economical advantages when used as surface trunk lines for connection and common initiation of the branches, especially when the number of branches is large.

The connection between a detonating cord and a low energy fuse is a critical point on which several requirements must be placed. For ignition safety reasons the cord is often laid out in loops which, however, makes it difficult to foresee from which cord direction the detonation will reach a particular branch. Hence the connection shall be bi-directional and independent of signal arrival direction. The point of contact between cord and fuse must be sufficient for ignition of the latter considering the short duration of the shock wave passage. If improperly designed, even an extended contact line may result in ignition failures since the cord impulse is generally faster than the fuse impulse, so that it may overtake an already established ignition in the fuse and extinguish it or cut the fuse in front of the impulse. The same results may be caused by splinters from ill-designed blocks and fixtures. The cord may also cut itself if folded so that a portion in advance of the detonation front is reached by a shock sufficient for tearing but insufficient for ignition. Finally it is desirable that the connection can be made easily and with reproducible results without too high requirements for skill.

Hitherto used connection means have only partially fulfilled the desired requirements and pick-up failures have not been uncommon. The simplest method of making the connection with a hand-tied knot does not give reproducible results unless substantial skill is exercised. Only certain types of knots re reliable and even with these a too rigid knot may compress and inhibit the fuses while a too loose knot may give tearing problems. The fuse and cord parts immediately surrounding the knot often become randomly oriented. Knots are seldom symmetrical and fully bi-directional. Various hooks and clips are also in use, either very simple in design or more elaborate like the devices shown in U.S. Pat. Nos. 3,175,491 or 3,431,849. In general these devices indeed give more reproducible positioning of the fuse parts but instead provide a too limited contact area and neglects the need for sustained suspect of the initial ignition.

SUMMARY OF THE INVENTION

A main object of this invention is to avoid the above-said problems and provide a method and means for a secure and simple connection of a detonating cord and low energy fuses, giving a reliable signal transmission under most field conditions.

According to the invention, connection is made by forming on a cord, extended for signal transmission, a fold or loop in such a way that the two halves of the fold stretch away from the main extension of the cord and by aligning with the cord halves a length of the fuse within signal receiving distance from both the fold halves. A fold or loop can easily be formed on an already extended trunk line without any need for cutting, knotting or threading. By stretching the fold halves away from the main direction of the trunk line, instead of along this direction, the cord detonation is securely directed away from the main direction to thereby limit the self-cutting risks for the cord. Now a substantial length of the fuse can be aligned with the fold halves, where detonation is strong and still be positioned across the main trunk line. The fuse will be affected by a substantial length of the cord and not only by a cross-over point. The broad and strong wave from the halves allows a distance adaption preventing fuse cut-offs. If the fuse is aligned with its intended signal direction coinciding with the fold detonation direction, the early signal in the fuse will be supported for a considerable distance. According to a preferred embodiment the cord and fuse can diverge in a signal direction to thereby further reduce cut-off risks. The behaviour of the connection will be independent of which cord half receives the detonation input. If the halves are in sufficient proximity to allow radial detonation flash-over, the halves will cooperate to amplify the above advantages. Yet the configuration of the cord and fuses is simple and simple devices can be used for locking the configuration.

Further objects and advantages will be evident from the following detailed description.

DETAILED DESCRIPTION

The detonating cord needs to have sufficient strength to initiate a low energy fuse placed in contact with it. Present commercial cords are fully usable. They normally contain a core of high explosive powder, such as PETN in an amount of 1 to 50 g/m, surrounded by layers of paper, wound filaments, ductile metal or plastic coating and have a detonation velocity between about 4000 and 8000 m/s. Detonating cords are exemplified in the U.S. Pat. No. 3,968,724 or the British Pat. No. 1,328,387.

Although the principles of the invention can be used to convey a signal between two detonating cords, it is preferably used when the signal receiving fuse is of the low energy type and, in particular, weak enough not to initiate the cooperating cord in contact therewith. Preferably the fuse loading is also small enough not to substantially disrupt its external layers on ignition so that it will have a retained structural integrity after use. Low energy fuses are of different types. They may be simpler to detonating cords but have a lower core loading, e.g. below 1 g/m, or have an energy absorbing cladding, for example as shown in U.S. Pat. No. 4,024,817. Preferably the invention is used in connection with low energy fuses of the hollow channel type, e.g. as described in U.S. Pat. Nos. 3,590,739 and 4,328,753, herein incorporated by reference, in which a rate determinant percussion wave is maintained in the gas channel by a small amount of a reactive agent.

According to the invention, a fold or loop shall be provided on a detonating cord trunk line so that the main extension of the trunk line is substantially unaltered but the cord in the two halves of the fold or loop extend away from the trunk line, i.e. become oriented substantially at a right angle to the trunk line. If the fold halves are close enough, the detonation arriving from one end of the trunk line will radially jump from one half to the other whereby the signal will proceed simultaneously in both halves away from the continuing signal in the main line. This will amplify and rectify the signal at the critical point of contact with the low energy fuse. Suitably, the flash-over point is close to the main extension of the trunk line and preferably the entire fold halves are in close alignment. The trunk line and the fold parts may lie in the same plane. A more reliable continuation of the trunk line detonation has been observed when there is a cross-over of the cord close to the trunk line main path, which can be obtained at this point by displacing the fold parts over each other or by rotating the fold halves into a loop. To form the fold or loop there is no need for cutting the cord although a cut somewhere in the folded core will not severely impair its function.

One or several fuses shall be positioned along the fold halves in sufficient proximity to be initiated by the detonation of at least one fold half. Preferably the fuse or fuses are placed symmetrically in relation to the halves, but perfect symmetry is not necessary as long as signal strength is sufficient. The general direction of the fuses shall be the same as the general direction for the fold halves, i.e. substantially at a right angle to the trunk line. The fuse or fuses can be kept in physical contact with or at a distance from the fold halves. Preferably the fuses are aligned with their intended signal direction matching the extension of the fold, whereby the detonation in at least one of the halves and preferably both, for above given reasons, will support signal build up in the fuse for a certain distance. The fuses may be substantially parallel to the fold axis to maximize signal strength along the entire fold. They may also form an angle with the fold axis, especially so that the fuse and cord diverge in signal direction, to thereby smoothly separate the fuse from the detonating fold and prevent an established fuse signal from being overrun. The fuses are preferably substantially straight in the vicinity of the fold but a straight portion may be combined with an inclined portion. The length, within which the fuse shall be kept within signal receiving distance from the cord fold, is suitably kept above 1 cm and is preferable between 2 and 10 cm, which also puts a limit on the minimum fold length.

A suitable connector shall include means for fixating a fold and directing it away from the main cord direction as well as means for positioning one or several fuses along the fold axis. Means for securing the other above-mentioned preferred configurations may also be included. It is preferred that the connector also includes locking means for at least the cord to prevent unintended removal after assembly. Such locking means may include a pin or other structure between the fold halves close to the fold tip to prevent its withdrawal. To confine detonation and protect the assembly until initiation, it is preferred to arrange the fixation means in a block of for example thermoplastics.

SUMMARY OF THE DRAWINGS

FIGS. 1A to 1G relates to a connector embodiment with a tubular hollow casing for the cord fold, wherein:

FIG. 1A is a front view,

FIG. 1B is a cross section along A—A of FIG. 1A,

FIGS. 1C and 1D are plan views of the connector with attached cord and one or two low energy fuses respectively, while FIGS. 1E to 1G are view of phases of assembly.

FIGS. 2A to 2G are views of a connector, embodiment with a bisected but hinged block with diverging channels for cord and fuse, wherein:

FIGS. 2A is a side view of the open connector,

FIG. 2B is a top view of the open connector,

FIGS. 2C and 2D are cross sections along A—A and B—B, respectively in FIG. 2B and FIGS. 2E to 2G are views of phases of assembly.

DESCRIPTION OF THE DRAWINGS

Figure 1A:
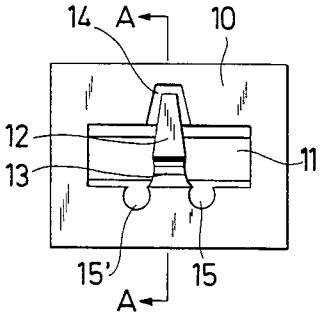
Figure 1B:
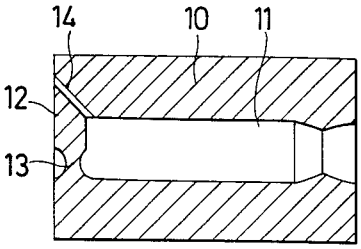

In FIGS. 1A to 1G reference 10 indicates a generally tubular casing of rectangular cross section with a likewise rectangular channel 11 of dimensions adapted to receive a plane fold of detonating cord. In the far end of casing 10, a lip 12 is provided, spanning the short axis of rectangular channel 11. A weakening 13 acts as a hinge, allowing forward motion of the lip under insertion of the cord fold while rearward motion is prevented by stop 14 on casing 10. Straight cavities 15 and 15' with open communication to channel 11 are provided to receive low energy fuses.

Figure 1C:
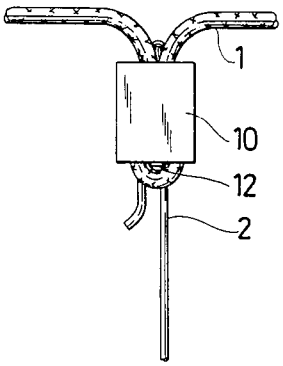
Figure 1D:
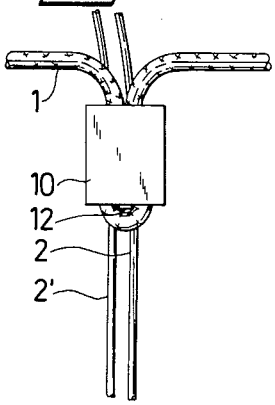
Figure 1E:
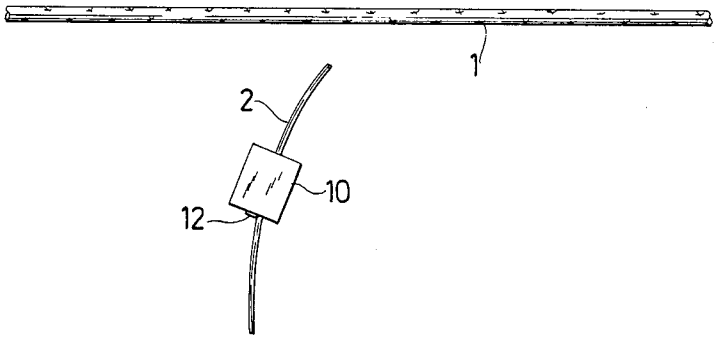
Figure 1F:
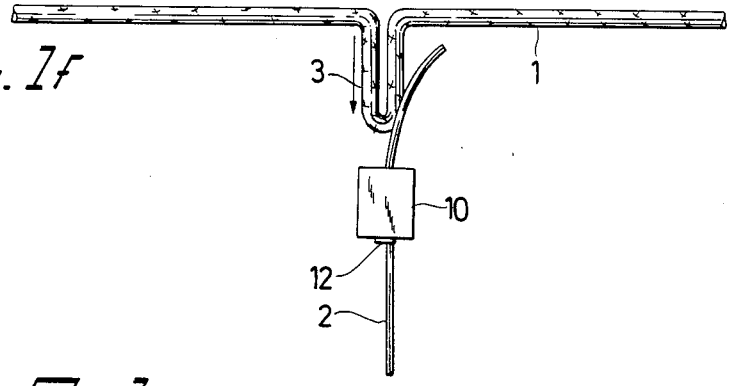
Figure 1G:
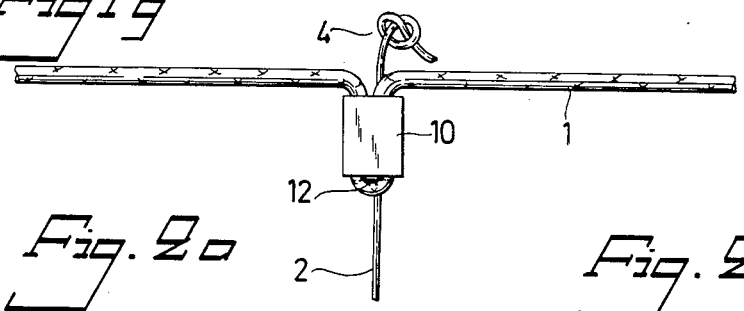

The manner of use is indicated in FIGS. 1C to 1G. At a detonating cord trunkline 1, low energy fuse 2 is placed in channel 15 and on cord 1, a fold 3 with close halves is moved into channel 11 of casing 10 until lip 12 is first pivoted forward and then sprung back between the halves of fold 3 to prevent its withdrawal. Fuse 2 can be secured with a knot 4 and optionally threaded back through parallel channel 15' as indicated in FIG. 1C. Alternatively, two fuses 2 can be placed in channels 15 and 15' according to FIG. 1D.

In FIGS. 2A to 2G a connector block, bisected in the intended cord fold plane, is shown comprising a lower part 20 and an upper part 21 joined in a hinge 22. A fuse channel 23 passes through the lower part 20 substantially parallel to its lower surface and is in communication with the upper surface of part 20 via a slit 24, likewise penetrating the lower part 20 of the block. One or several fuses can be positioned in channel 23, either by being threaded through this channel or by being inserted through slit 24. A cavity 25 is arranged to receive a fold of detonating cord and another cavity 26 is arranged to receive a part of the cord ends extending at right angles away from the fold. The axis of cavity 25 is not parallel with channel 23 but is inclined to give an increasing distance to channel 23 in the direction away from trunkline cavity 26. The upper part 21 of the block can be rotated around hinge 22 into a position covering the upper surface of lower part 20. Hooks 28 on the interior side of upper part 21 penetrate holes 29 with undercut on lower part 20 and locks the two parts in closed position. Thin ridges 27 on the upper part 21, arranged transversely over the fold halves and the trunk line parts, exerts a slight pressure on these parts in the closed position of the block.

Figure 2A:
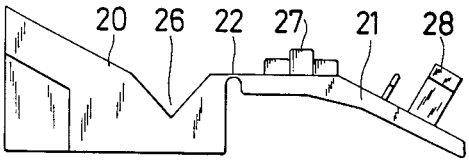
Figure 2C:
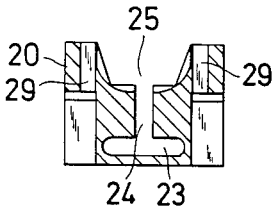
Figure 2B:
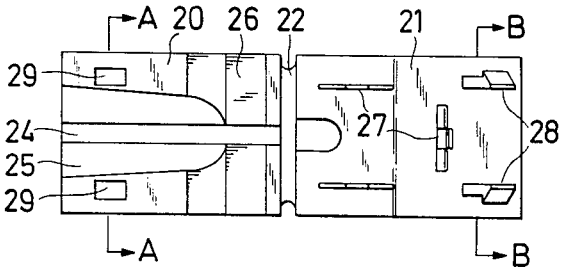
Figure 2D:
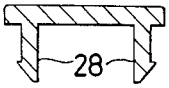
Figure 2E:
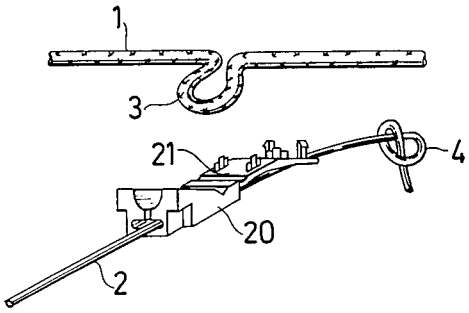
Figure 2F:
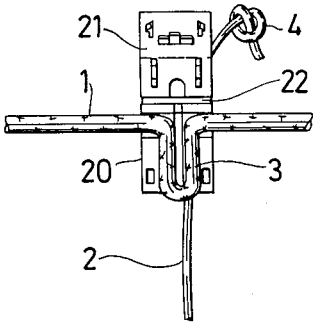
Figure 2G:
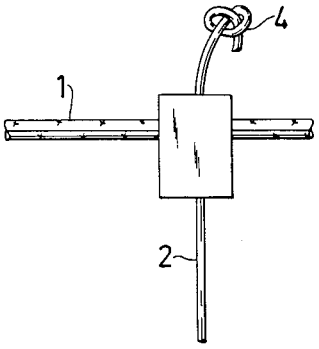

The manner of use is indicated in FIGS. 2E to 2G. A low energy fuse 2 is threaded through channel 23 and is secured by knot 4. A fold 3 on a detonating cord 1 is placed in cavity 25 and part of the cord trunk line in cavity 26. Upper part 21 and lower part 20 are then joined and snapped into a locked position via hooks 28 and holes 29.

Figure 3:
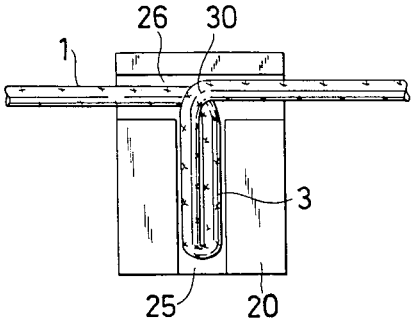
FIG. 3 is a schematic view of a block for a looped cord with cross-over point.

FIG. 3 shows schematicly an alternative way of positioning the cord in the block of FIG. 2A to 2G. Cord 1 and its fold 3 are placed in cavities 26 and 25 of lower part 20 respectively but fold 3 has been rotated to give a cross-over point for the cord at 30.

I claim:

1. A connector for securing signal transmission from a detonating cord to a shock wave initiable low energy fuse, comprising:

guiding means for fixation of a fold on the cord;

guiding means for receiving a portion of the detonating cord adjacent the fold so that the two halves of the fold extend away from the direction of the cord adjacent the fold; and guiding means for fixation of the fuse within signal receiving distance along both halves in the fold.

2. The connector of claim 1, including a tubular shell within which the cord fold can be inserted and a lip arranged in one end of the shell and in such a manner that after insertion of the fold in the shell the lip will extend through the fold loop.

3. The connector of claim 1, wherein the guiding means for fixation of the fuse and the guiding means for fixation of the cord fold are arranged to form a diverging angle between the cord fold and the fuse.

4. A connector for securing signal transmission from a detonating cord to a shock wave initiable low energy fuse, comprising:

guiding means for fixation of a fold on the cord so that the two halves of the fold extend away from a direction of the cord adjacent the fold;

guiding means for fixation of the fuse within signal receiving distance of both halves of the fold;

wherein the connector is divided into two halves;

the guiding means for the cord fold are arranged on interior surfaces of the connector halves; and means are provided for locking the halves after insertion of the cord fold.

5. The connector of claim 4, wherein the connector is bisected into two halves substantially in the cord fold plane.

6. The connector of claim 4, wherein the connector halves are joined in a hinge.

7. A connector for securing signal transmission from a detonating cord to a shock wave initiable low energy fuse, comprising:

guiding means for fixation of a fold of the cord so that the two halves of the fold extend away from a direction of the cord adjacent the fold;

guiding means for fixation of the fuse within signal receiving distance of both halves of the fold;

wherein the guiding means for the fold permits the cord to have an overlap in a plane above the general plane of the fold.

8. A method for transmitting a signal from a detonating cord to a shock wave initiable low energy fuse comprising the steps of:

forming a fold in the cord so that two halves of the fold extend away from the length of the cord adjacent the fold;

positioning a length of the fuse within signal receiving distance of both fold halves; and initiating the cord.

9. The method of claim 8, further comprising the step of sustaining a rate determinant percussion wave in a gas channel in the fuse by a reactive agent.

10. The method of claim 8, wherein the forming step includes placing the halves of the fold within sufficient proximity of each other to allow radial detonation transmission between the halves.

11. The method of claim 10, further comprising the step of sustaining a rate determinant percussion wave in a gas channel in the fuse by a reactive agent.

12. The method of claim 8, wherein the forming step includes overlapping cord parts perpendicular to the fold plane.

13. The method of claim 12, further comprising the step of sustaining a rate determinant percussion wave in a gas channel in the fuse by a reactive agent.

14. The method of claim 8, further comprising aligning the fuse along the fold halves with the intended signal direction of the fuse coinciding with the intended signal direction of the fold halves, i.e., away from the main length of the cord.

15. The method of claim 14, further comprising the step of sustaining a rate determinant percussion wave in a gas channel in the fuse by a reactive agent.

16. The method of claim 14, wherein the positioning step includes positioning the fuse so that it diverges away from the fold halves.

17. The method of claim 16, further comprising the step of sustaining a rate determinant percussion wave in a gas channel in the fuse by a reactive agent.

18. A connector for securing signal transmission from a detonating cord to a shock wave initiable low energy fuse, comprising:

means for receiving a fold of the detonating cord;

means for locking the fold within the receiving means; and guiding means for fixation of the fuse within signal receiving distance of the receiving means;

said guiding means being parallel with said receiving means, narrower than said receiving means, and in open communication with said receiving means along an axial direction of the connector.

19. The connector of claim 18, wherein the locking means includes a tab pivotably connected to the receiving means.

* * * * *